US008237755B2

(12) United States Patent
Kim et al.

(10) Patent No.: US 8,237,755 B2
(45) Date of Patent: Aug. 7, 2012

(54) APPARATUS AND METHOD FOR DRIVING A LIQUID CRYSTAL DISPLAY DEVICE

(75) Inventors: Sung Hoon Kim, Daegu-si (KR); Ki Jeong Lee, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 839 days.

(21) Appl. No.: 12/314,606

(22) Filed: Dec. 12, 2008

(65) Prior Publication Data

US 2009/0225106 A1 Sep. 10, 2009

(30) Foreign Application Priority Data

Mar. 5, 2008 (KR) ..... 10-2008-0020472

(51) Int. Cl.
*G09G 5/10* (2006.01)

(52) U.S. Cl. ..... 345/691; 345/38

(58) Field of Classification Search ..... 345/691
See application file for complete search history.

(56) References Cited

U.S. PATENT DOCUMENTS

| | | | | |
|---|---|---|---|---|
| 5,648,793 | A * | 7/1997 | Chen | 345/96 |
| 6,624,828 | B1 * | 9/2003 | Dresevic et al. | 715/771 |
| 7,834,834 | B2 * | 11/2010 | Takatani et al. | 345/87 |
| 7,880,703 | B2 * | 2/2011 | Park et al. | 345/87 |
| 7,903,063 | B2 * | 3/2011 | Chung et al. | 345/87 |
| 2006/0044290 | A1 * | 3/2006 | Hurwitz et al. | 345/204 |
| 2007/0252801 | A1 * | 11/2007 | Park et al. | 345/88 |

* cited by examiner

*Primary Examiner* — Alexander S Beck
*Assistant Examiner* — Mihir Rayan
(74) *Attorney, Agent, or Firm* — McKenna Long & Aldridge LLP

(57) ABSTRACT

An apparatus and method for driving a liquid crystal display device, which can selectively provide a wide viewing angle and a narrow viewing angle and improve the narrow viewing angle characteristics. The driving apparatus includes a liquid crystal panel having quad type unit pixels each including red, green and blue (RGB) sub-pixels and an electrical controlled birefringence (ECB) sub-pixel, a data driver for driving data lines of the liquid crystal panel, a gate driver for driving gate lines of the liquid crystal panel, and a timing controller for generating ECB data based on externally inputted RGB video data such that each of the unit pixels maintains a brightness of a constant level to form a narrow viewing angle, arranging the generated ECB data together with the video data and supplying the arranged data to the data driver.

7 Claims, 5 Drawing Sheets

APPARATUS AND METHOD FOR DRIVING A LIQUID CRYSTAL DISPLAY DEVICE

This application claims the benefit of the Korean Patent Application No. 10-2008-0020472, filed on Mar. 5, 2008, which is hereby incorporated by reference for all purposes as if fully set forth herein.

BACKGROUND OF THE INVENTION

1. Field of the Invention

The present invention relates to a liquid crystal display device, and more particularly, to an apparatus and method for driving a liquid crystal display device, which can selectively provide a wide viewing angle and a narrow viewing angle and improve narrow viewing angle characteristics.

2. Discussion of the Related Art

In general, a liquid crystal display device displays an image by injecting a liquid crystal between two substrates and applying an electric field to the liquid crystal through electrodes facing each other with the liquid crystal interposed therebetween to adjust light transmittance of the liquid crystal.

Such liquid crystal display devices may be classified into a liquid crystal display device of a vertical electric field application type and a liquid crystal display device of a horizontal electric field application type depending on the direction of an electric field applied to drive the liquid crystal.

The liquid crystal mode of the vertical electric field application type is a twisted nematic (TN) mode where the liquid crystal is driven by a vertical electric field between a pixel electrode and a common electrode disposed on a lower and an upper substrate respectively to face each other. In the TN mode, a large aperture ratio can be provided because both the common electrode on the upper substrate and the pixel electrode on the lower substrate forming the vertical electric field are transparent electrodes. However, because the liquid crystal is vertically driven by the vertical electric field, the motion of the liquid crystal has an effect on light traveling laterally. As a result, the viewing angle of the liquid crystal display device is narrowed to about 90°.

The liquid crystal mode of the horizontal electric field application type is an in-plane switching (IPS) mode where the liquid crystal is driven by a horizontal electric field between a pixel electrode and a common electrode arranged in parallel on a lower substrate. In the IPS mode, because the liquid crystal is horizontally driven by the horizontal electric field, there is little vertical motion of the liquid crystal. As a result, the motion of the liquid crystal has little effect on light traveling laterally, so that the viewing angle of the liquid crystal display device is widened to about 160°.

Conventionally, liquid crystal cells formed in a liquid crystal panel of a liquid crystal display device are arranged in a stripe type. However, a liquid crystal display device has been developed which comprises a liquid crystal panel having a quad type cell structure including one electrically controlled birefringence (ECB) sub-pixel and three red, green and blue (RGB) sub-pixels to enable selective switching between a wide viewing angle mode and a narrow viewing angle mode.

As shown in FIG. 1, a liquid crystal cell of a quad type includes a red (R) sub-pixel, a green (G) sub-pixel, a blue (B) sub-pixel, and an ECB sub-pixel, in which the R and G sub-pixels are arranged horizontally and the ECB and B sub-pixels are arranged in parallel with the R and G sub-pixels.

The R and ECB sub-pixels, positioned vertically with respect to each other, are connected in common to a first data line DL1, and the G and B sub-pixels, positioned vertically with respect to each other, are connected in common to a second data line DL2. Also, the R and G sub-pixels, positioned horizontally with respect to each other, are connected in common to a first gate line GL1, and the ECB sub-pixel and B sub-pixel, positioned horizontally with respect to each other, are connected in common to a second gate line GL2.

Here, the ECB sub-pixel is used to coordinate the wide viewing angle mode and the narrow viewing angle mode. In other words, the respective RGB sub-pixels are used to display an original image, and the ECB sub-pixel is used to display an interference image such that the original image is not accurately viewed in a lateral direction of the liquid crystal panel (for example, a direction of about 45° from the front of the liquid crystal panel).

The interference image is also displayed by the ECB sub-pixel while the original image is displayed by the RGB sub-pixels. As a result, the original image and the interference image are simultaneously displayed in the lateral direction of the liquid crystal panel. That is, in the front of the liquid crystal panel, only the original image is viewed and the interference image is not viewed, but in the lateral direction of the liquid crystal panel, an overlap of the original image and the interference image is viewed, thus providing a narrow viewing angle.

However, the conventional liquid crystal panel with the quad type cell structure is disadvantageous in that it has to output a black original image onto a white background image such that only the original image is viewed in the front of the liquid crystal panel. In other words, in order to allow the interference image not to be viewed in the front of the liquid crystal panel and only the original image to be viewed in the front of the liquid crystal panel, there is a monotony of having to display an image of low brightness on a background image of high brightness. Provided that a white image is outputted onto a black background image, an overlap of the original image and the interference image will be viewed even in the front of the liquid crystal panel.

On the other hand, in the case where image boundaries are clearly distinguished by the original image, for example, a black letter or a corresponding image is displayed on a white background, a phenomenon that the brightnesses of the image boundaries are prominently seen may occur even though the interference image is displayed by the ECB sub-pixel. As a result, the original image may be identified at the viewing angle, resulting in difficulty in providing a narrow viewing angle.

SUMMARY OF THE INVENTION

Accordingly, the present invention is directed to an apparatus and method for driving a liquid crystal display device that substantially obviate one or more problems due to limitations and disadvantages of the related art.

An advantage of the present invention is to provide an apparatus and method for driving a liquid crystal display device, which can selectively provide a wide viewing angle and a narrow viewing angle and improve narrow viewing angle characteristics.

Additional advantages, objects, and features of the invention will be set forth in part in the description which follows, and in part will become apparent from the description or may be learned from practice of the invention. The objectives and other advantages of the invention will be realized and attained by the structure particularly pointed out in the written description and claims hereof as well as the appended drawings.

To achieve these objects and other advantages and in accordance with the purpose of the invention, as embodied and broadly described herein, an apparatus for driving a liquid crystal display device comprises, a liquid crystal panel having quad type unit pixels each including RGB sub-pixels and an ECB sub-pixel; a data driver for driving data lines of the liquid crystal panel; a gate driver for driving gate lines of the liquid crystal panel; and a timing controller for generating ECB data based on externally inputted RGB video data such that each of the unit pixels maintains a brightness at a constant level to form a narrow viewing angle, arranging the generated ECB data together with the video data and supplying the arranged data to the data driver.

In another aspect of the present invention, a method for driving a liquid crystal display device, where the liquid crystal display device comprises a liquid crystal panel having quad type unit pixels each including RGB sub-pixels and an ECB sub-pixel, comprises, generating ECB data based on externally inputted RGB video data such that each of the unit pixels maintains a brightness at a constant level to form a narrow viewing angle; and arranging the generated ECB data together with the video data and outputting the arranged data.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification illustrate embodiment(s) of the invention and together with the description serve to explain the principle of the invention.

In the drawings.

DETAILED DESCRIPTION OF THE ILLUSTRATED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
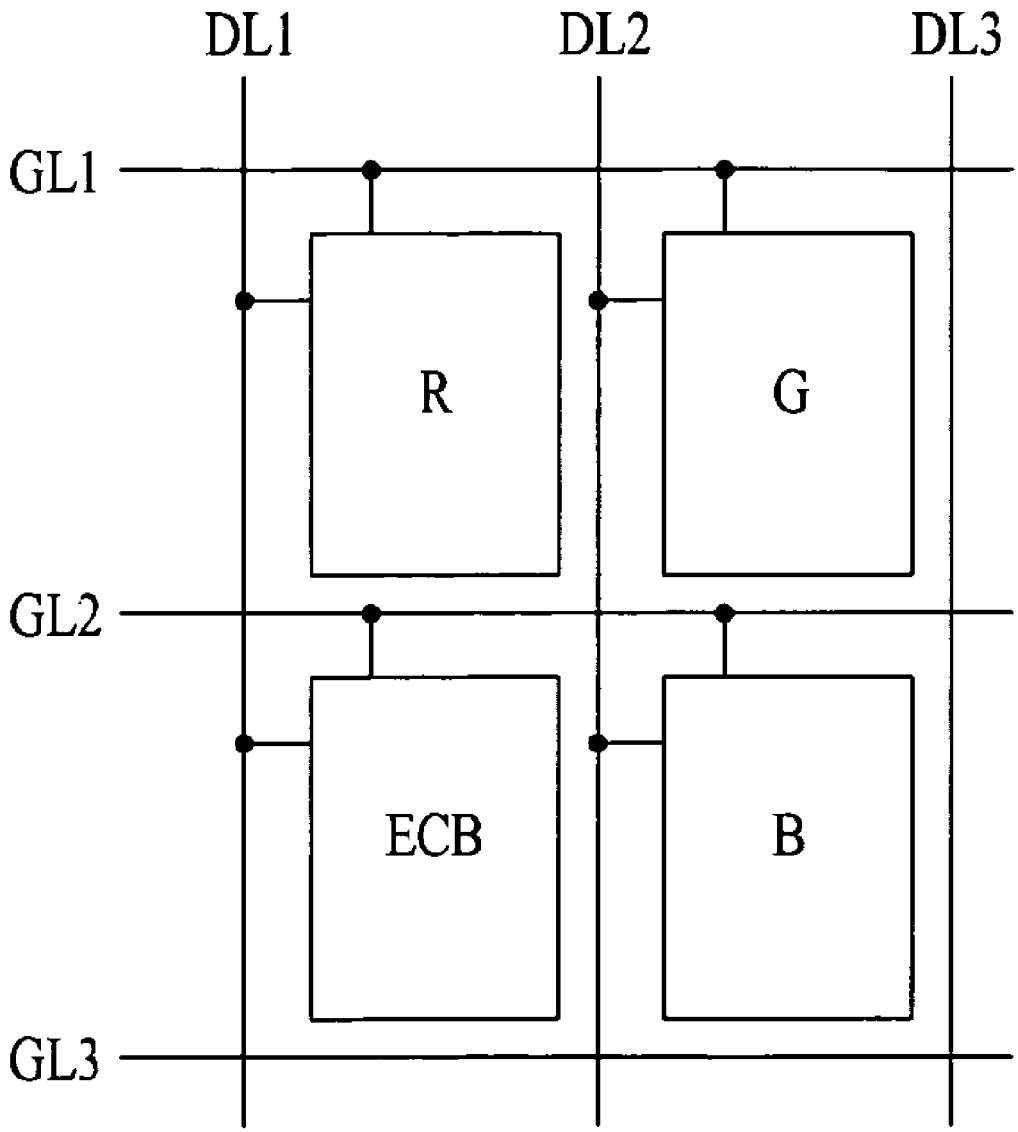
FIG. 1 Related Art
FIG. 1 is a schematic view of a unit pixel of a conventional liquid crystal panel.
Figure 2:
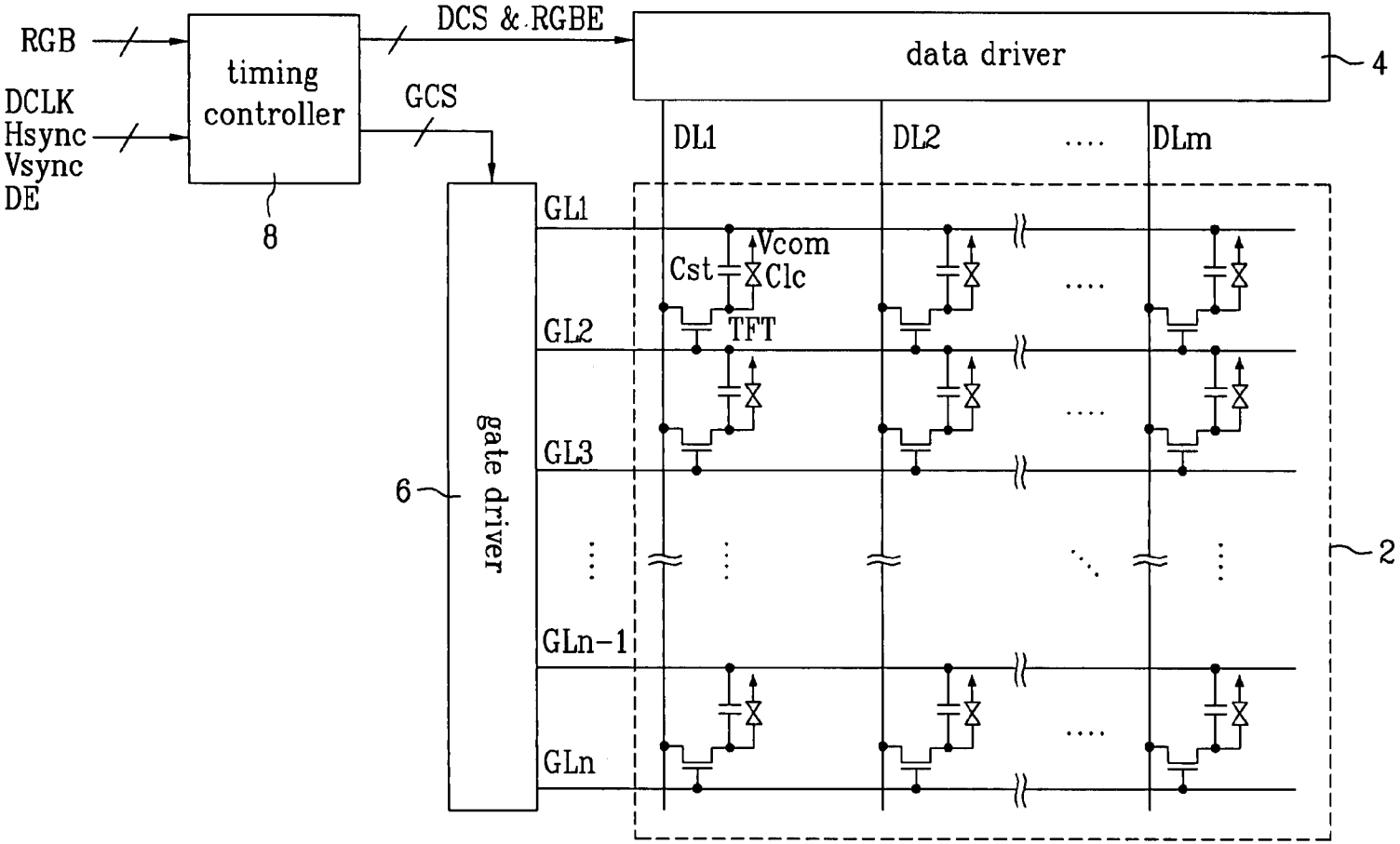
FIG. 2 is a schematic view of a driving apparatus of a liquid crystal display device according to a first embodiment of the present invention.

FIG. 2 is a schematic view of a driving apparatus of a liquid crystal display device according to a first embodiment of the present invention.

Referring to FIG. 2, the driving apparatus of the liquid crystal display device comprises a liquid crystal panel 2 having quad type unit pixels each including RGB sub-pixels and an ECB sub-pixel, a data driver 4 for driving data lines DL1 to DLm of the liquid crystal panel 2, a gate driver 6 for driving gate lines GL1 to GLm of the liquid crystal panel 2, and a timing controller 8 for generating ECB data E based on externally inputted video data RGB such that each of the unit pixels maintains a brightness at a constant level to form a narrow viewing angle and supplying the generated ECB data E to the data driver 4 together with the video data RGB, and generating gate control signals (GCS) and data control signals (DCS) to control the gate and data drivers 6 and 4, respectively.

The liquid crystal panel 2 includes thin film transistors (TFTs) formed respectively in R, G, B and ECB sub-pixel areas defined by the gate lines GL1 to GLn and the data lines DL1 to DLm, and liquid crystal capacitors Clc connected respectively to the TFTs. Each liquid crystal capacitor Clc is made up of a pixel electrode connected to the corresponding TFT, and a common electrode facing the pixel electrode with a liquid crystal interposed therebetween. Each TFT supplies a video signal from a corresponding one of the data lines DL1 to DLm to the pixel electrode in response to a scan pulse from a corresponding one of the gate lines GL1 to GLn. The liquid crystal capacitor Clc is charged with a difference voltage between the video signal supplied to the pixel electrode and a reference common voltage supplied to the common electrode, and varies the alignment of liquid crystal molecules based on the difference voltage to adjust light transmittance of the liquid crystal molecules so as to provide a gray scale. A storage capacitor Cst is connected in parallel to the liquid crystal capacitor Clc to maintain the video signal charged in the liquid crystal capacitor Clc until a next video signal is supplied thereto. The storage capacitor Cst is formed by an overlap of the pixel electrode and a previous gate line via an insulating film. Alternatively, the storage capacitor Cst may be formed by an overlap of the pixel electrode and a storage line via an insulating film. This liquid crystal panel 2 of the present invention will be described later in more detail with reference to the annexed drawings.

The data driver 4 converts arranged video data RGBE from the timing controller 8 into analog voltages, or video signals, using a source start pulse SSP, a source shift clock SSC, etc. among the DCS from the timing controller 8. In detail, the data driver 4 latches video data RGBE inputted thereto in response to the source shift clock SSC among the DCS, and then supplies video signals of one horizontal line respectively to the data lines DL1 to DLm in response to a source output enable signal (SOE) among the DCS in every horizontal period where a scan pulse is supplied to each gate line GL1 to GLn. The data driver 4 selects positive or negative gamma voltages having certain levels based on gray scale values of the inputted video data RGBE and supplies the selected gamma voltages as video signals to the respective data lines DL1 to DLm.

The gate driver 6 sequentially generates scan pulses in response to the GCS, for example, a gate start pulse (GSP) and a gate shift clock (GSC), from the timing controller 8 and controls pulse widths of the scan pulses in response to a gate output enable signal (GOE) from the timing controller 8. Then, the gate driver 6 sequentially supplies the pulse width-controlled scan pulses, or gate-on voltages, to the gate lines GL1 to GLn. In detail, the gate driver 6 shifts the GSP from the timing controller 8 in response to the GSC from the timing controller 8 to sequentially generate scan pulses. Then, the gate driver 6 controls pulse widths of the scan pulses in response to the gate output enable signal GOE from the timing controller 8 and sequentially supplies the pulse width-controlled gate-on voltages to the gate lines GL1 to GLn. On the other hand, gate-off voltages are supplied to the gate lines GL1 to GLn in a period in which the gate-on voltages are not supplied to the gate lines GL1 to GLn.

The timing controller 8 generates ECB data E based on externally inputted video data RGB such that each unit pixel maintains a brightness of a constant level to form a narrow viewing angle. In detail, the timing controller 8 has at least one memory to output ECB data E corresponding to externally inputted video data RGB. Here, the ECB data E is preset to correspond to a gray scale value or brightness value of the video data RGB and then stored in at least one memory. In detail, the ECB data E may be a gray scale value of the ECB sub-pixel corresponding to a sum of respective gray scale values of R, G and B video data or a brightness value of the ECB sub-pixel corresponding to a sum of respective brightness values of R, G and B video data. The timing controller 8 generates the ECB data E in this manner and supplies the ECB data E to the data driver 4 together with the inputted video data RGB. Also, the timing controller 8 generates GCS and DCS to control the gate and data drivers 6 and 4, respectively. This timing controller 8 will be described later in more detail with reference to the annexed drawings.

Figure 3:
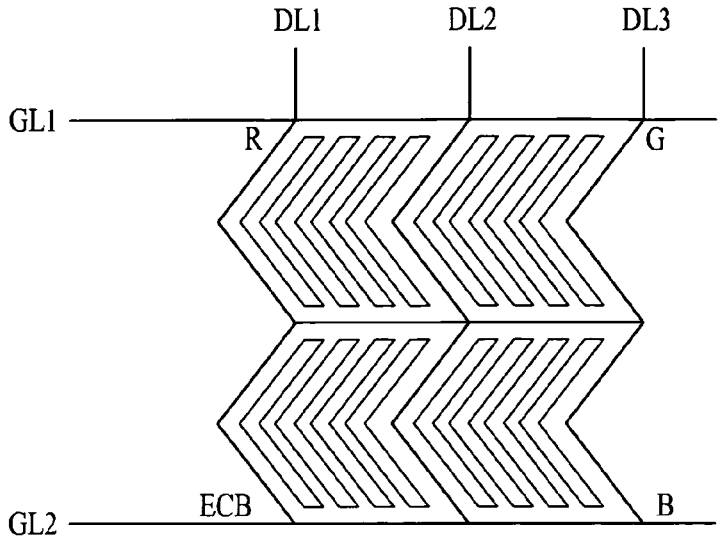
FIG. 3 is a schematic plan view of a unit pixel of a liquid crystal panel shown in FIG. 2.
Figure 4:
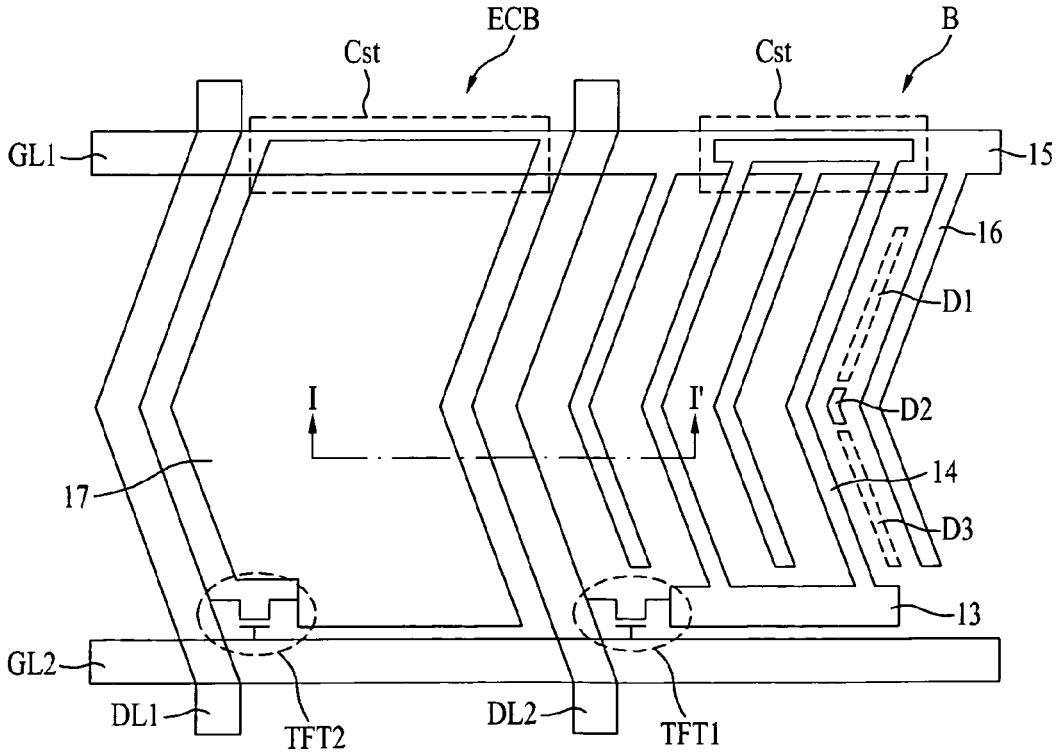
FIG. 4 is a detailed plan view of an ECB sub-pixel and a B sub-pixel in FIG. 3.

FIG. 3 is a schematic plan view of a unit pixel of the liquid crystal panel shown in FIG. 2. FIG. 4 is a detailed plan view of an ECB sub-pixel and a B sub-pixel in FIG. 3, and FIG. 5 is a schematic sectional view taken along a line I-I' of FIG. 4.

Referring to FIG. 3, a quad type unit pixel P includes adjacent red (R), green (G) and blue (B) sub-pixels R, G and B, and an ECB sub-pixel for control of a viewing angle. In each unit pixel P, the R sub-pixel and the G sub-pixel are arranged horizontally. The ECB sub-pixel is arranged diagonally with respect to the G sub-pixel, vertically with respect to the R sub-pixel and horizontally with respect to the B sub-pixel.

In the liquid crystal display device according to the first embodiment of the present invention, in a structure where the R, G and B sub-pixels and the ECB sub-pixel constitute one unit pixel P, left and right viewing angles can be reduced by allowing a sum of a brightness displayed by the R, G and B sub-pixels and a brightness displayed by the ECB sub-pixel to be maintained as constant as possible. In other words, in each unit pixel P, the brightness of the ECB sub-pixel is adjusted based on the brightness displayed by the R, G and B sub-pixels so that a brightness displayed by each unit pixel P can be maintained as constant as possible at a certain level while an image is displayed. In this manner, it is possible to provide a narrow viewing angle mode where it is difficult to identify an image at both sides of the liquid crystal panel 2.

Figure 5:
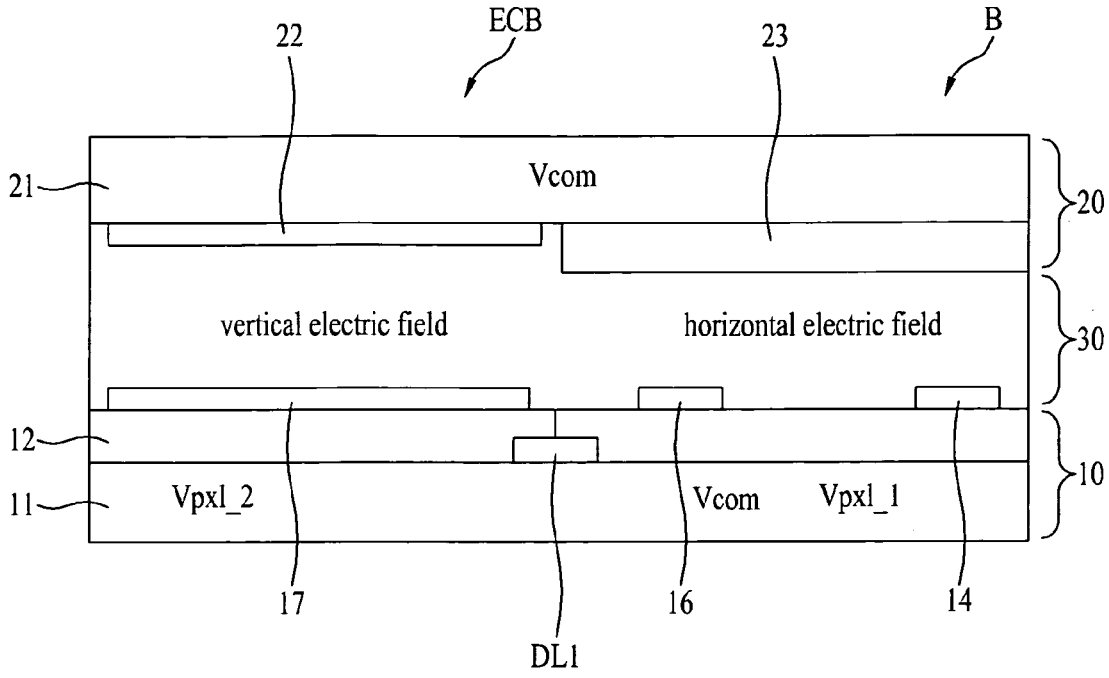
FIG. 5 is a schematic sectional view taken along a line I-I' of FIG. 4.

Referring to FIGS. 4 and 5, the liquid crystal panel 2 includes an upper substrate 20, and a lower substrate 10 for controlling the alignment of a liquid crystal layer 30 to adjust the amount of light to be transmitted to the upper substrate 20.

As shown in FIG. 5, each unit pixel P of the lower substrate 10 includes R, G and B sub-pixels each for forming a horizontal electric field to control the alignment of the liquid crystal layer 30, and an ECB sub-pixel for forming a vertical electric field to control the alignment of the liquid crystal layer 30. Here, each of the R, G and B sub-pixels R, G and B has an IPS structure and the ECB sub-pixel has an ECB structure (or TN structure). Thus, each of the R, G and B sub-pixels or the ECB sub-pixel forms the horizontal electric field or vertical electric field when a difference voltage between a video signal (or analog video voltage) or viewing angle control voltage (or ECB control voltage) and a common voltage is applied.

In the B sub-pixel B, a thin film transistor TFT1 is disposed at an intersection of the second gate line GL2 and the second data line DL2, and a pixel line 13 is connected to the thin film transistor TFT1 and disposed in parallel with the second gate line GL2. First pixel electrodes 14 are connected with the pixel line 13 and disposed in parallel with the second data line DL2, and first common electrodes 16 are formed alternately with the first pixel electrodes 14. The first common electrodes 16 are connected to one another via a common line 15 which is disposed in parallel with the second gate line GL2. In this manner, the R, G and B sub-pixels may be implemented in various forms in the range of the horizontal electric field structure where the plurality of gate lines GL1 to GLn and the plurality of data lines DL1 to DLm are arranged to intersect each other, the plurality of TFTs are formed respectively at the intersections of the gate lines GL1 to GLn and the data lines DL1 to DLm, and the first pixel electrodes 14 and the first common electrodes 16 are alternately formed to generate the horizontal electric field. For example, the first pixel electrodes 14 and the first common electrodes 16 may be arranged in straight line forms in parallel with each other. Alternatively, the first pixel electrodes 14 and the first common electrodes 16 may each have one or more bent portions such that multiple domains D1, D2 and D3 in which the liquid crystal is aligned in different directions are formed between each of the first pixel electrodes 14 and each of the first common electrodes 16. Particularly, in the case where each sub-pixel has a bent structure, a response speed or color shift function can be improved, so as to improve an image quality.

In the ECB sub-pixel, a thin film transistor TFT2 is disposed at an intersection of the second gate line GL2 and the first data line DL1, and a second pixel electrode 17 is connected to the thin film transistor TFT2 as shown in FIG. 4. A second common electrode 22 is disposed on the upper substrate 20 to face the second pixel electrode 17. See FIG. 5. In this ECB sub-pixel, a viewing angle control signal Vpx1_2 and a common voltage Vcom are applied respectively to the second pixel electrode 17 and the second common electrode 22 to form the vertical electric field to control the viewing angle.

In the same manner to a blue color filter 23 being formed in an area of the upper substrate 20 facing the B sub-pixel, red, green and blue color filters are formed on the upper substrate 20 to correspond to the R, G and B sub-pixels respectively. The second common electrode 22 is formed at the top of the ECB sub-pixel to form the vertical electric field with the second pixel electrode 17.

Formed in each unit pixel P is a storage capacitor Cst for maintaining a driving voltage charged in a liquid crystal cell, namely, a difference voltage between the video signal Vpxl_1 applied to the first pixel electrode 14 and the common voltage Vcom or a difference voltage between the viewing angle control signal Vpxl_2 applied to the second pixel electrode 17 and the common voltage Vcom until a next voltage is charged in the liquid crystal cell. This storage capacitor Cst may be formed by an overlap of the common line 15 and pixel electrode 14 or 17 with one or more insulating films 12 interposed therebetween.

Figure 6:
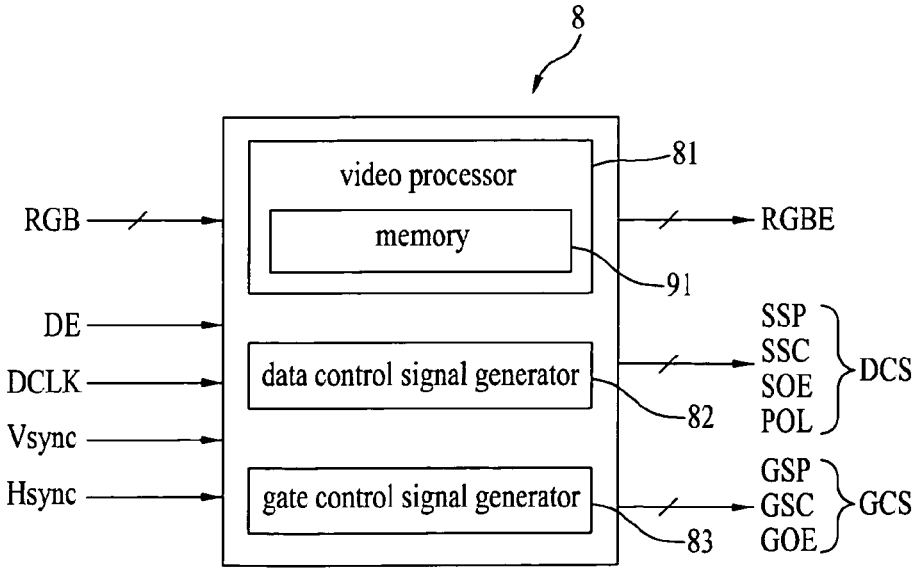
FIG. 6 is a block diagram of a timing controller shown in FIG. 2.

FIG. 6 is a block diagram of the timing controller shown in FIG. 2.

Referring to FIG. 6, the timing controller 8 includes a video processor 81 for generating ECB data E based on externally inputted video data RGB using at least one memory such that each unit pixel maintains a brightness of a constant level to form a narrow viewing angle, and supplying the generated ECB data E to the data driver 4 together with the video data RGB, a data control signal generator 82 for generating data control signals DCS for driving of the data driver 4 using at least one of externally inputted synchronous signals Dot Clock (DCLK), Data Enable (DE), Horizontal Synchronous (Hsync) and Vertical Synchronous (Vsync) and supplying the generated data control signals DCS to the data driver 4, and a gate control signal generator 83 for generating gate control signals GCS for driving of the gate driver 6 using at least one of the synchronous signals DCLK, DE, Hsync and Vsync and supplying the generated gate control signals GCS to the gate driver 6.

The video processor 81 has at least one memory 91 to generate ECB data E corresponding to externally inputted video data RGB. The ECB data E is preset to correspond to a gray scale value of the video data RGB and then stored in the memory 91. The memory 91 may include at least one look-up table. A method for generating the ECB data E will hereinafter be described in detail with reference to FIG. 7 and Tables 1 and 2.

TABLE 1

| Red LUT | | Green LUT | | Blue LUT | |
|---|---|---|---|---|---|
| Gray | R_Value | Gray | G_Value | Gray | B_Value |
| 0 | 0 | 0 | 0 | 0 | 0 |
| 1 | 0 | 1 | 0 | 1 | 0 |
| 2 | 0 | 2 | 0 | 2 | 0 |
| . | . | . | . | . | . |
| . | . | . | . | . | . |
| . | . | . | . | . | . |
| 253 | 68 | 253 | 144 | 253 | 42 |
| 254 | 68 | 254 | 144 | 254 | 42 |
| 255 | 68 | 255 | 144 | 255 | 42 |

TABLE 2

| R + G + B Value | ECB Value |
|---|---|
| 0 | 61 |
| 1 | 57 |
| 2 | 56 |
| 3 | 56 |
| 4 | 55 |
| 5 | 55 |
| 6 | 54 |
| 7 | 54 |
| 8 | 53 |
| 9 | 53 |
| 10 | 52 |
| 11 | 52 |
| 12 | 51 |
| 13 | 51 |
| 14 | 50 |
| 15 | 50 |
| . | . |
| . | . |
| . | . |
| 249 | 0 |
| 250 | 0 |
| 251 | 0 |
| 252 | 0 |
| 253 | 0 |
| 254 | 0 |

As seen from the Table 1, an R conversion value R_Value preset to correspond to a gray scale value of R data, a G conversion value G_Value preset to correspond to a gray scale value of G data, and a B conversion value B_Value preset to correspond to a gray scale value of B data are stored in a certain area of the memory 91 of the video processor 81. Here, the respective R, G and B conversion values R_Value, G_Value and B_Value may be arbitrarily set values corresponding respectively to the gray scale values of the R, G and B data. For example, the respective R, G and B conversion values R_Value, G_Value and B_Value may be scaled-down ones of the gray scale values of the R, G and B data, or may be just the gray scale values of the R, G and B data.

Figure 7:
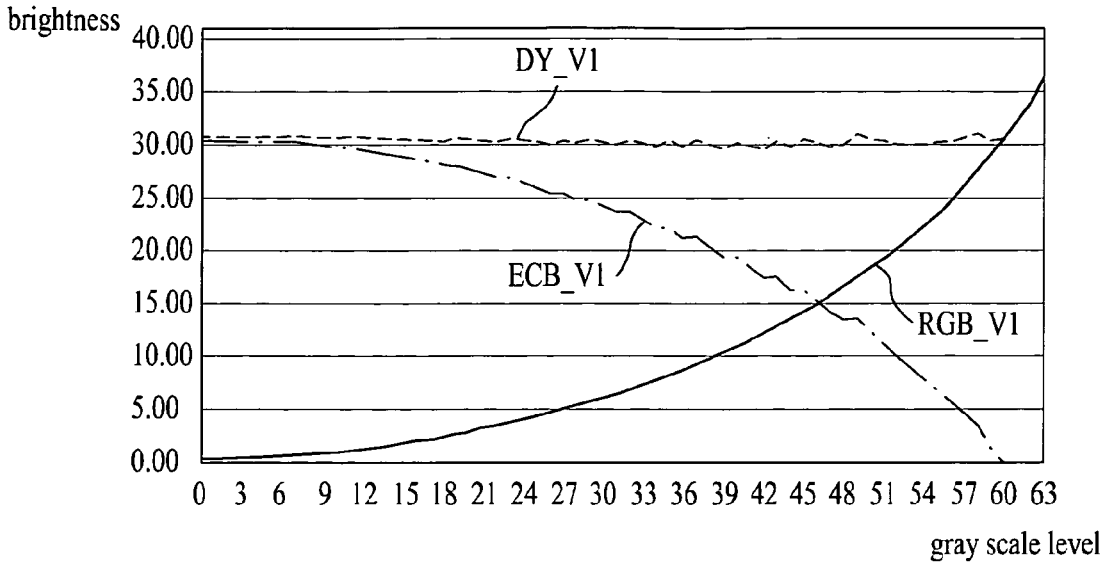
FIG. 7 is a graph illustrating display brightnesses of unit pixels and display brightnesses of ECB sub-pixels according to the first embodiment of the present invention.

Also, as seen from the Table 2, ECB data E corresponding to a sum R+G+B Value of the R, G and B conversion values is stored in another area of the memory 91. At this time, the ECB data E is set such that a sum of a brightness RGB_V1 displayed through the R, G and B sub-pixels R, G and B and a brightness ECB_V1 displayed through the ECB sub-pixel, namely, a brightness DY_V1 displayed through each unit pixel P is maintained as constant as possible, as shown in FIG. 7. In detail, the ECB data E is set such that the brightness ECB_V1 displayed through the ECB sub-pixel is lower when the brightness RGB_V1 displayed through the R, G and B sub-pixels R, G and B is higher, and higher when the brightness RGB_V1 displayed through the R, G and B sub-pixels R, G and B is lower.

In more detail, when video data RGB is externally inputted, the video processor 81 extracts, from the memory 91, a R conversion value R_Value corresponding to the R data R, a G conversion value G_Value corresponding to the G data G, and a B conversion value B_Value corresponding to the B data B. Then, the video processor 81 obtains a sum R+G+B Value of the extracted R, G and B conversion values R_Value, G_Value and B_Value. Then, the video processor 81 extracts ECB data E corresponding to the obtained sum R+G+B Value from the memory 91.

Thereafter, the video processor 81 arranges the video data RGB, externally inputted in every horizontal period, and the extracted ECB data E suitably to the size and resolution of the liquid crystal panel 2 using at least one of externally inputted synchronous signals, for example, a dot clock DCLK, a data enable signal DE, a vertical synchronous signal Vsync and a horizontal synchronous signal Hsync. Then, the video processor 81 sequentially supplies the arranged video data RGBE to the data driver 4 on a horizontal period basis. As a result, the brightness DY_V1 displayed through each unit pixel P is maintained at a constant level, as shown in FIG. 7, thereby providing a narrow viewing angle mode where it is difficult to identify an image at both sides of the liquid crystal panel 2.

On the other hand, the data control signal generator 82 generates data control signals (DCS), for example, a source start pulse (SSP), a source shift clock (SSC), a source output enable signal (SOE) and a polarity control signal (POL) using at least one of the synchronous signals DCLK, DE, Hsync and Vsync and supplies the generated data control signals (DCS) to the data driver 4. These data control signals (DCS) are signals for control of a driving timing of the data driver 4. Here, the polarity control signal (POL) is a signal for conversion of the polarity of a video signal to be supplied to each data line DL1 to DLm.

The gate control signal generator 83 generates gate control signals (GCS), for example, a gate start pulse (GSP), a gate shift clock (GSC) and a gate output enable signal (GOE) using at least one of the synchronous signals DCLK, DE, Hsync and Vsync and supplies the generated gate control signals GCS to the gate driver 6. These gate control signals GCS are signals for control of a driving timing of the gate driver 6.

As described above, the driving apparatus of the liquid crystal display device according to the first embodiment of the present invention extracts ECB data E set such that the display brightness of the unit pixels P are maintained at the same level, based on externally inputted video data RGB using at least one memory 91. Then, the driving apparatus converts the extracted ECB data E into a viewing angle control signal Vpxl_2 to provide a narrow viewing angle.

However, in the case where the ECB sub-pixels are driven to maintain the display brightness of the unit pixels P at the same level, there is a problem that the effect is somewhat reduced when a brightness difference among image patterns being displayed becomes larger. For example, in the case where black patterns are displayed on a white background, the boundaries between unit pixels displaying the black patterns and unit pixels displaying the white background may be displayed in gray color due to an overlap of brightness displayed. That is, because color temperature shifting is seen, black letters may be displayed in gray color during document creation, resulting in a reduction in narrow viewing angle effect.

In order to solve the above problem, a driving apparatus of a liquid crystal display device according to a second embodiment of the present invention drives ECB sub-pixels in such a manner that display brightness of unit pixels P is swung with a predetermined width while being maintained at the same level.

Hereinafter, the driving apparatus and method of the liquid crystal display device according to the second embodiment of the present invention will be described in detail with reference to FIG. 8 and Table 3.

Figure 8:
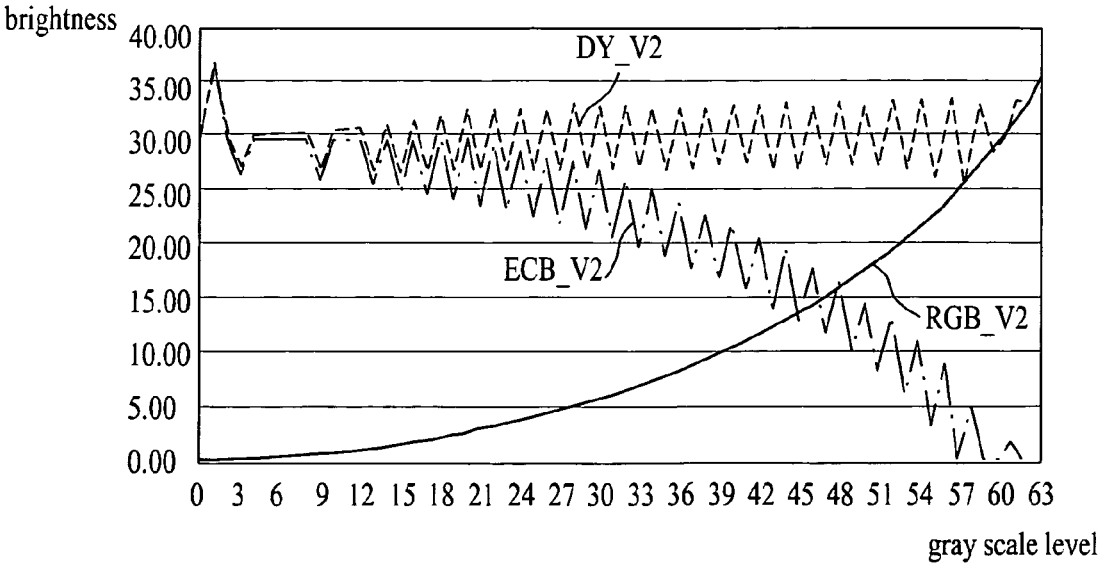
FIG. 8 is a graph illustrating display brightnesses of unit pixels and display brightnesses of ECB sub-pixels according to a second embodiment of the present invention.

FIG. 8 is a graph illustrating display brightness of unit pixels and display brightness of ECB sub-pixels according to a second embodiment of the present invention.

The driving apparatus of the liquid crystal display device according to the second embodiment of the present invention is the same in configuration and operation as the driving apparatus of the liquid crystal display device according to the first embodiment of the present invention shown in FIGS. 2 to 6, with the exception of the operation of the video processor 81 included in the timing controller 8. Therefore, a description of the configuration of the driving apparatus of the liquid crystal display device according to the second embodiment of the present invention will be replaced by the above description given with reference to FIGS. 2 to 6.

Stored in the memory 91 of the video processor 91 according to the second embodiment of the present invention are a gray scale value (gray scale level) of R, G and B data, a brightness value (RGB brightness) displayed through R, G and B sub-pixels R, G and B based on the gray scale value, and a brightness value (ECB brightness) of an ECB sub-pixel corresponding to the RGB brightness value, as seen from the Table 3.

Here, the ECB brightness value is set such that a sum of the RGB brightness RGB_V2 displayed through the R, G and B sub-pixels R, G and B and the ECB brightness ECB_V2 displayed through the ECB sub-pixel, namely, an RGB+ECB brightness DY_V2 displayed through each unit pixel P is swung with a predetermined width while being maintained at a constant level, as shown in the Table 3 and FIG. 8.

In detail, when the brightness RGB_V2 displayed through the R, G and B sub-pixels is higher, the brightness ECB_V2 displayed through the ECB sub-pixel is set to be lower. Conversely, when the brightness RGB_V2 displayed through the R, G and B sub-pixels is lower, the brightness ECB_V2 displayed through the ECB sub-pixel is set to be higher. In this manner, the RGB+ECB brightness DY_V2 is maintained at a constant level. Together with this, the brightness ECB_V2 displayed through the ECB sub-pixel is set to be repetitively swung within a brightness range of 1 to 8, so that a brightness difference between adjacent unit pixels P is repetitively swung within the range of 0.8 to 1.2.

TABLE 3

| Gray Scale Level | RGB Brightness | RGB + ECB Brightness | ECB Brightness | Brightness Difference Adjacent Gray Scales |
|---|---|---|---|---|
| 0 | 0.26 | 29.86 | — | 0.817 |
| 1 | 0.27 | 36.57 | 36.30 | 1.223 |
| 2 | 0.30 | 29.90 | 29.60 | 1.123 |
| 3 | 0.33 | 26.63 | 26.30 | 0.889 |
| 4 | 0.37 | 29.96 | 29.59 | 0.999 |
| 5 | 0.42 | 30.00 | 29.58 | 0.998 |
| 6 | 0.48 | 30.06 | 29.58 | 0.998 |
| 7 | 0.58 | 30.12 | 29.54 | 0.997 |
| 8 | 0.65 | 30.20 | 29.55 | 1.140 |
| 9 | 0.74 | 26.49 | 25.75 | 0.872 |
| 10 | 0.83 | 30.39 | 29.56 | 0.996 |
| 11 | 0.95 | 30.52 | 29.57 | 0.995 |
| 12 | 1.09 | 30.66 | 29.57 | 1.155 |
| 13 | 1.24 | 26.54 | 25.30 | 0.857 |
| 14 | 1.40 | 30.98 | 29.58 | 1.172 |
| 15 | 1.61 | 26.44 | 24.83 | 0.843 |
| 16 | 1.68 | 31.38 | 29.50 | 1.179 |
| 17 | 2.02 | 26.62 | 24.60 | 0.836 |
| 18 | 2.26 | 31.85 | 29.59 | 1.195 |
| 19 | 2.59 | 26.65 | 24.06 | 0.823 |
| 20 | 2.79 | 32.38 | 29.59 | 1.217 |
| 21 | 3.16 | 26.61 | 23.45 | 0.820 |
| 22 | 3.36 | 32.47 | 29.11 | 1.218 |
| 23 | 3.66 | 26.65 | 22.99 | 0.823 |
| . | . | . | . | . |
| . | . | . | . | . |
| . | . | . | . | . |
| 48 | 16.51 | 32.94 | 16.43 | 1.206 |
| 49 | 17.37 | 27.31 | 9.94 | 0.836 |
| 50 | 18.28 | 32.67 | 14.39 | 1.195 |
| 51 | 19.21 | 27.33 | 8.12 | 0.820 |
| 52 | 20.17 | 33.32 | 13.15 | 1.226 |
| 53 | 21.18 | 27.17 | 5.99 | 0.817 |
| 54 | 22.25 | 33.25 | 11.00 | 1.263 |
| 55 | 23.33 | 26.32 | 2.99 | 0.785 |
| 56 | 24.65 | 33.55 | 8.90 | 1.288 |
| 57 | 26.05 | 26.05 | 0.00 | 0.798 |
| 58 | 27.58 | 32.64 | 5.06 | 1.122 |
| 59 | 29.09 | 29.09 | 0.00 | 0.950 |
| 60 | 30.63 | 30.63 | 0.00 | 0.906 |
| 61 | 32.28 | 33.82 | 1.54 | 0.996 |
| 62 | 33.97 | 33.97 | 0.00 | 0.930 |
| 63 | 36.57 | 36.52 | 0.00 | 0 |

In more detail, when video data RGB is externally inputted, the video processor 81 extracts an RGB brightness value corresponding to a gray scale value of the R, G and B data from the memory 91. Then, the video processor 81 extracts ECB data E corresponding to the extracted RGB brightness value from the memory 91. Here, the ECB data E may be a gray scale value or brightness data value for provision of a pre-stored ECB brightness.

Thereafter, the video processor 81 arranges the video data RGB, externally inputted in every horizontal period, and the extracted ECB data E suitably to the size and resolution of the liquid crystal panel 2 using at least one of externally inputted synchronous signals, for example, a DCLK, a DE, a Vsync and a Hsync. Then, the video processor 81 sequentially supplies the arranged video data RGBE to the data driver 4 on a horizontal period basis. As a result, the brightness DY_V2 displayed through each unit pixel P is swung with a predetermined width while being maintained at a constant level, as shown in FIG. 8, thereby providing a narrow viewing angle mode where it is difficult to identify an image at both sides of the liquid crystal panel 2.

As apparent from the above description, an apparatus and method for driving a liquid crystal display according to the present invention have effects as follows.

In a liquid crystal panel with a quad type cell structure, the brightness of an ECB sub-pixel is adjusted according to the user's setting so that the liquid crystal panel can be controlled to provide a wide viewing angle or narrow viewing angle.

In addition, the brightness of the ECB sub-pixel is adjusted such that the display brightness of each unit pixel of the liquid crystal panel is swung with a predetermined width while being maintained at a certain level. Therefore, it is possible to improve a narrow viewing angle formation efficiency.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for driving a liquid crystal display device, comprising:

a liquid crystal panel having quad type unit pixels each including red, green and blue (RGB) sub-pixels and an electrical controlled birefringence (ECB) sub-pixel;

a data driver for driving data lines of the liquid crystal panel;

a gate driver for driving gate lines of the liquid crystal panel; and a timing controller for generating ECB data based on externally inputted RGB video data such that each of the unit pixels maintains a brightness at a constant level to form a narrow viewing angle, arranging the generated ECB data together with the externally inputted RGB video data and supplying the arranged data to the data driver, wherein the ECB data is set such that an RGB+ECB brightness displayed through each of the unit pixels is repetitively swung with a width preset by a user while being maintained at the constant level, wherein only the ECB data is set such that the brightness displayed through the ECB sub-pixel is repetitively swung within a brightness range preset by the user, so that an RGB+ECB brightness is repetitively swung within a brightness range preset.

2. The apparatus according to claim 1, wherein the timing controller comprises:

a video processor for generating the ECB data based on a gray scale value or brightness value of the externally inputted video data using at least one memory such that each of the unit pixels maintains the brightness at the constant level;

a data control signal generator for generating data control signals using at least one of externally inputted synchronous signals and supplying the generated data control signals to the data driver; and a gate control signal generator for generating gate control signals using at least one of the synchronous signals and supplying the generated gate control signals to the gate driver.

3. The apparatus according to claim 2, wherein the at least one memory includes at least one look-up table for storing the gray scale value of the red (R), green (G) and blue (B) data, an RGB brightness value displayed through the R, G and B sub-pixels based on the gray scale value, and the ECB data corresponding to the RGB brightness value.

4. The apparatus according to claim 3, wherein the ECB data is set such that a brightness displayed through the ECB sub-pixel is lower when the brightness displayed through the R, G and B sub-pixels is higher, and higher when the brightness displayed through the R, G and B sub-pixels is lower, so that the RGB+ECB brightness is maintained at the constant level.

5. A method for driving a liquid crystal display device, the liquid crystal display device comprising a liquid crystal panel having quad type unit pixels each including red green and blue (RGB) sub-pixels and an electrical controlled birefringence (ECB) sub-pixel, the method comprising:

generating ECB data based on externally inputted RGB video data such that each of the unit pixels maintains a brightness at a constant level to form a narrow viewing angle; and arranging the generated ECB data together with the video data and outputting the rranged data, wherein the ECB data is set such that an RGB+ECB brightness displayed through each of the unit pixels is repetitively swung with a width preset by a user while being maintained at the constant level, wherein only the ECB data is set such that the brightness displayed through the ECB sub-pixel is repetitively swung within a brightness range preset by the user, so that an RGB+ECB brightness is repetitively swung within a brightness range preset.

6. The method according to claim 5, wherein the ECB data generating step comprises, using a gray scale value of the red (R), green (G) and blue (B) data and an RGB brightness value displayed through the R, G and B sub-pixels based on the gray scale value, stored in a memory including at least one look-up table, extracting the ECB data corresponding to the RGB brightness value from the memory.

7. The method according to claim 6, wherein the ECB data is set such that a brightness displayed through the ECB sub-pixel is lower when the brightness displayed through the R, G and B sub-pixels is higher, and higher when the brightness displayed through the R, G and B sub-pixels is lower, so that an RGB+ECB brightness displayed through each of the unit pixels is maintained at the constant level.

* * * * *